United States Patent [19]

Young et al.

[11] 4,078,542

[45] Mar. 14, 1978

[54] FIREPLACE GRATE AND BLOWER

[75] Inventors: Byron H. Young, Morton; Jon D. Bridgwater, Washington, both of Ill.

[73] Assignee: Morton Metalcraft Co., Morton, Ill.

[21] Appl. No.: 713,610

[22] Filed: Aug. 11, 1976

[51] Int. Cl.[2] ..... F23H 13/00

[52] U.S. Cl. ..... 126/164; D7/207; 165/165

[58] Field of Search ..... 126/121, 164, 165, 163 R, 126/163 A; 165/165; D7/207, 212

[56] References Cited

U.S. PATENT DOCUMENTS

| | | | |
|---|---|---|---|
| 3,240,206 | 3/1966 | Schutt | 126/163 R |
| 3,537,513 | 11/1970 | Austin et al. | 165/165 |
| 3,582,250 | 6/1971 | Chatfield | 126/164 |
| 3,635,211 | 1/1972 | Englert | 126/121 |

FOREIGN PATENT DOCUMENTS

| | | | |
|---|---|---|---|
| 74,394 | 12/1948 | Norway | 126/121 |
| 901,860 | 7/1962 | United Kingdom | 126/121 |

*Primary Examiner*—Ronald C. Capossela
*Attorney, Agent, or Firm*—Browdy and Neimark

[57] ABSTRACT

A fireplace heat transfer unit consists of a forced-air-fed distribution manifold extending across the rear of the fireplace parallel to the back wall, a series of heat transfer conduits interconnected with the manifold and extending forwardly from it to the fireplace opening, supported by a generally rectangular, side-walled grate enclosure from which support legs extend downwardly at each corner, an expanded-metal coal grate positioned on the grate enclosure below the heat transfer conduits to hold glowing coals in proximity to the conduits and in proximity to the manifold, the heat transfer conduits having restricting orifices where connected to the distribution manifold and at the emission orifices through which heated air is directed into the room. Forced air input is provided by an enclosed, heat-protected electric blower which may be positioned just inside of the fireplace on either side of the heat transfer unit, connected to the manifold by means of a heat transfer conduit at either end.

9 Claims, 7 Drawing Figures

FIREPLACE GRATE AND BLOWER

FIELD OF THE INVENTION

The present invention relates to improved heat utilization, and, more particularly, to a home fireplace heat transfer unit for improved utilization of heat generated in such fireplace.

BACKGROUND OF THE INVENTION

There has been an on-going effort to more efficiently capture the heat generated by fireplace fires and to so direct that heat to raise the temperature of living quarters rather than permitting such heat to escape through the chimney. In a conventional fireplace heat is generated to the living quarters primarily by radiation only, approximately 90 to 95 percent of its heating capacity being lost to the outside atmosphere. Thus, a device which can effectively capture and circulate into a room, such as by convection, some of this waste heat would be extremely beneficial and, in fact, previous attempts at developing such a device have been made.

In particular, Englert U.S. Pat. No. 3,635,211 shows a heat exchanger with grate and air transporting pipes located below the fuel media leading to triangular fins above the fuel media. A blowing means is used to assist movement of air through the system. Hatfield et al. U.S. Pat. No. 3,905,351 shows a heat distribution unit with heating conduit in a V-shaped version and a manifold located at the front of the device. A blower is provided adjacent to the manifold.

In Maasberg U.S. Pat. No. 3,269,385 a manifold is located at the rear and contains a blower within its interior. The log supporting elements are tubular and are provided with air outlets along their length. In Schutt U.S. Pat. No. 3,240,206 the manifold is tubular and located in the rear connecting the blower and log supporting element. A means is also provided for feeding oxygen to the fire. The Stites U.S. Pat. No. 2,901,212 shows a U-shaped heating conduit wherein the lower portion of the conduit supports the logs. The device is equipped with a manifold and blower at the bottom front end with the blower located outside the fireplace.

Each of the above units entail the passing of forced air through conduits or a system of conduits, which conduits are heated by the fireplace fire, thereby heating the air passing therethrough, such heated air being directed into the room. These prior units are, however, believed to be lacking in one or more important characteristics, for example: simplicity and therefore economy of construction, efficiency of heat transfer from the core of the fire in terms of output per unit of fuel burned, ready adaptability to size of fireplace, attractive rather than detractive appearance, portability with ease.

SUMMARY OF THE INVENTION

It is, accordingly, an object of the present invention to overcome the deficiencies of the prior art, such as indicated above.

A further object is to provide for improved heat transfer.

Yet another object is to provide an improved yet inexpensive fireplace grate for improved heat transfer.

Another object of this invention is to provide a fireplace heat transfer unit which fits comfortably and attractively within the fireplace opening and does not disturb the operation of the fireplace screen.

A further object of this invention is to provide a fireplace heat transfer unit which yields measurable improvement in heat output per unit of fuel consumed.

Yet another object of the present invention is to provide a fireplace heat transfer unit which also acts as a basket for the fireplace and contains a removable grate for easy cleaning.

The present invention comprises a fireplace heat transfer system of simple yet rugged construction characterized by a heat protected blower located inside the fireplace opening, a distribution manifold which feeds air from the blower to a plurality of heat transfer and fuel supporting conduits, a removable grating for catching so-called "hot coals", optionally a heating fin-grid matrix located within each heating conduit to increase the heat transfer surface of such conduits, and surrounding angled panels to catch off-falling pieces of burning fuel and "hot coals" and direct them to the grating. An additional feature allows for the introduction of water into the distribution manifold through one of the heat transfer conduits which, when the system is in operation, provides desirable humidity to otherwise relatively dry heated air.

BRIEF DESCRIPTION OF THE DRAWINGS

Other objects and the nature and advantages of the instant invention will be better understood from the following detailed description of possible embodiments, with reference to the attached drawing, it being understood that such embodiments are illustrative and not limitative.

In the drawings.

DETAILED DESCRIPTION OF EMBODIMENTS

Figure 1:
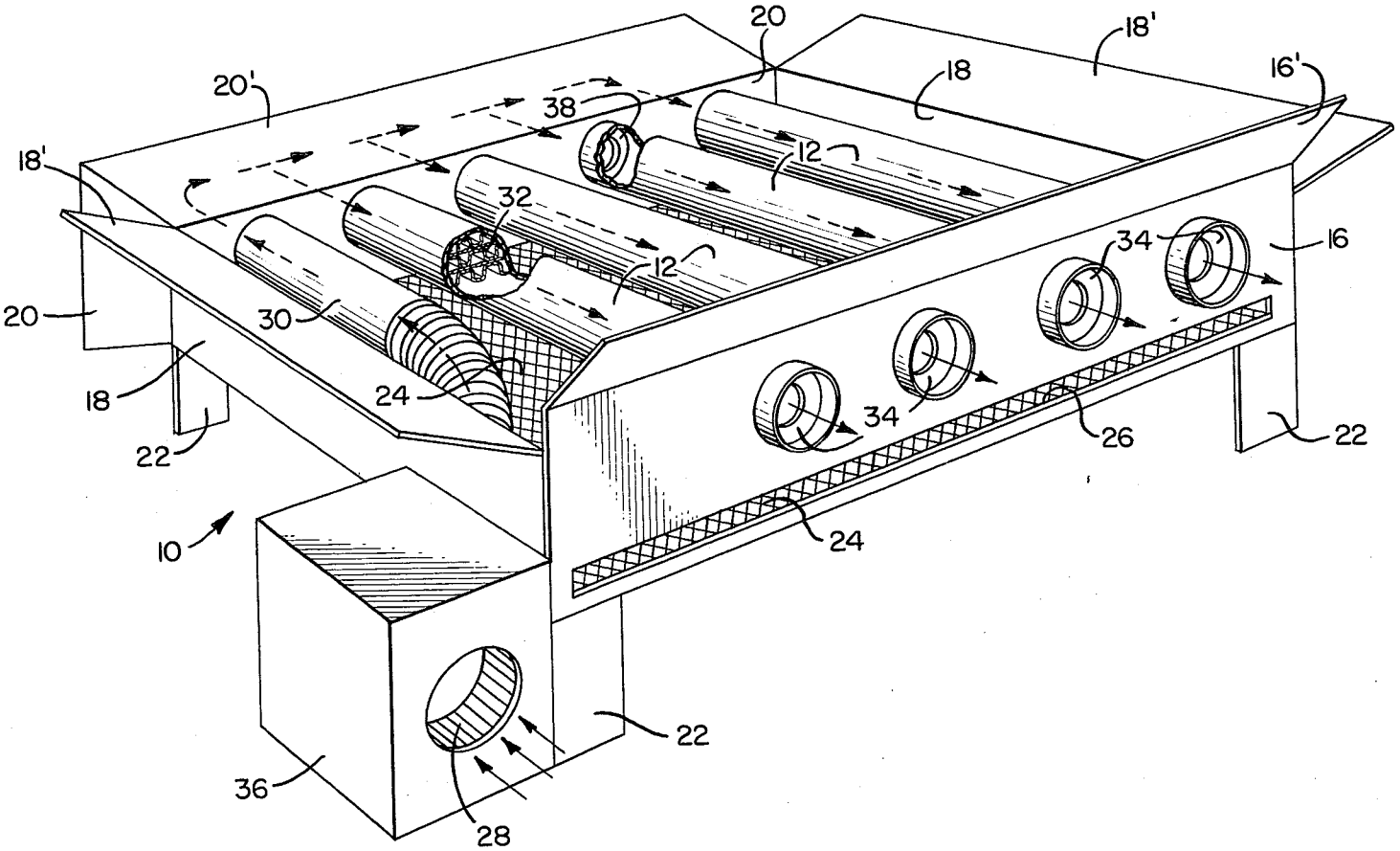
FIG. 1 is a partly broken away perspective view of a preferred fireplace heat transfer unit in accordance with the present invention.
Figure 3:
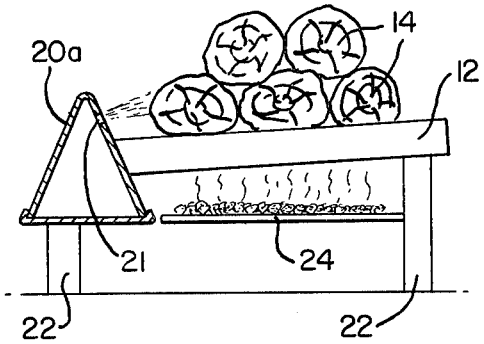
FIG. 3 is a partially schematic sectional view showing another embodiment.
Figure 4A:
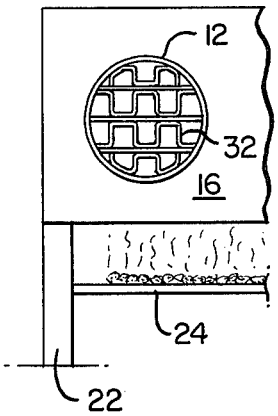
FIGS. 4A and 4B are partially schematic, broken away front views showing two embodiments of the heating conduits.
Figure 4B:
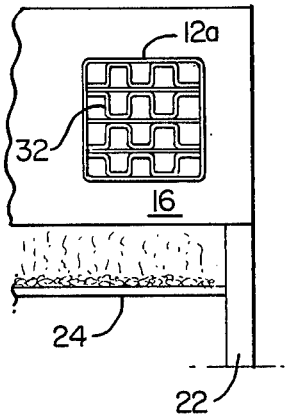

A preferred fireplace heat transfer system 10 of simple yet rugged construction designed to yield measurable improvement in heat output per unit of fuel consumed is shown in FIG. 1. The device 10 includes a series of heat transfer conduits 12 spaced from one another across the width of the device 10 and extending from the back to the front of such device, located at the front of the opening of the fireplace (see FIG. 2). Such conduits 12 serve the dual function of providing the primary support for the fuel, e.g. logs 14 as shown in FIG. 3, and the means within which air is heated and then passed into the room. The cross-sectional shape of the conduits 12 is not critical, although circular cross-section shown in FIGS. 1, 2, 4A, 5A and 5B is preferred; another possible shape is shown by the square cross-sectional conduit 12*a* of FIG. 4B.

The ends of the conduits 12 are preferably mounted in and/or removably supported by a generally rectangular grate enclosure constituting a front panel 16, a pair of side panels 18 and a manifold 20 at the rear, the ends of the conduits 12 being in one possible variant welded to or mechanically interconnected with the front panel 16 and manifold 20. The top portion 20' of the manifold, the side-walls 18 and the front panel 16 each angle outwardly as they extend upwardly, providing portions 18' and 16', respectively, such angles being appropriate to catch off-falling pieces of burning logs and direct such pieces back to the coal bed on the grate beneath the heat transfer conduits 12. The walls of the grate enclosure also serve to cause a plenum effect concentrating the heat generated to the combustion area for effective heat transfer.

The grate enclosure is supported by four legs 22, one extending downwardly from each corner of the grate enclosure. A screen-like metal grating 24, preferably formed of expanded metal, lays loosely in the grate enclosure and is positioned under the heat transfer conduits 12. Suitable means, such as supportive metal returns bent inwardly from the side and front panels 16 and 18 are provided to releasably support such grating 24, so it may be replaced as desired, or removed for cleaning if so desired. In the embodiment of FIG. 1, an aperture 26 is provided in the front panel 16 through which the grating 24 may be slid for insertion, removal and re-insertion.

The manifold 20, the front portion of which forms the back of the grate enclosure, serves as a distributor of air which is drawn into the device and then distributed by the manifold 20 to each of the heat transfer conduits 12, as shown by the schematic arrows in FIG. 1. The manifold 20 preferably has a trapezoidal cross-section as shown in FIG. 1, but alternate embodiments may comprise the manifold **20*a* of FIG. 5A having a triangular cross-section, or the manifold 20*b* of FIG. 5B having an oval or elliptical cross-section. If desired, a series of small holes 21 may be provided in the manifold along its length, whereby a stream of air 23** is bled therethrough to assist combustion.

Figure 2:
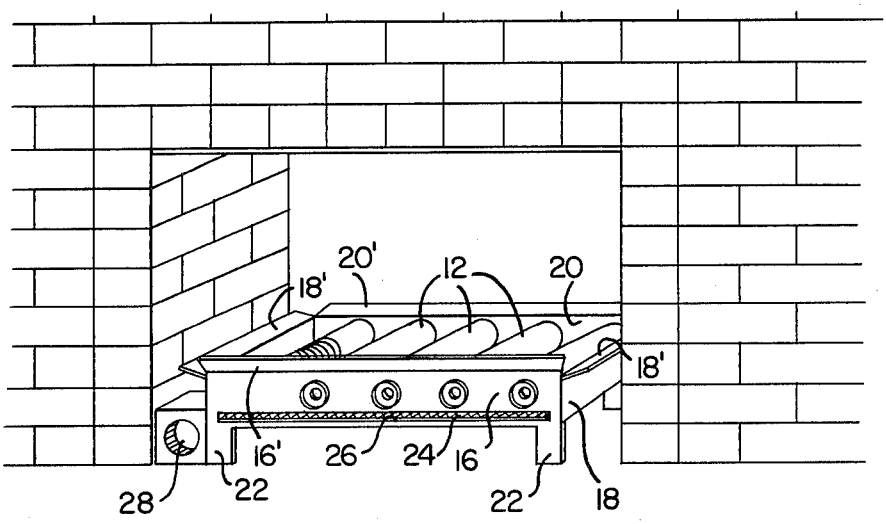
FIG. 2 is an illustration showing the position of the unit of FIG. 1 within a fireplace.
Figure 5A:
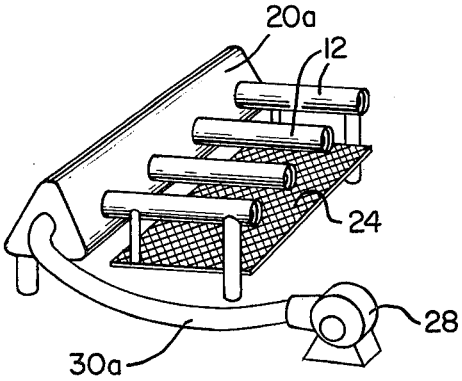
FIGS. 5A and 5B are partially schematic perspective views showing various alternatives.
Figure 5B:
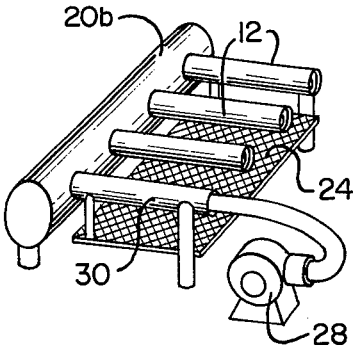

The device 10 preferably includes a heat-protected blower 28 which may be located inside of the fireplace opening as shown in FIG. 2 on either the right hand or left hand side so that it does not disturb the operation or appearance of a movable fireplace screen. The blower 28 is connected to the right hand or left hand end of the distribution manifold 20 by means of a partially flexible metal feeder tube 30. The air distribution manifold 20 extends across the rear of the fireplace parallel to the fireplace back wall. Instead of connecting to the tube 30, the blower 28 may instead connect to a tube **30*a* as shown in FIG. 5*a*, the tube 30*a*** then connecting to the end wall of the manifold.

Another feature of the preferred construction is the utilization of a sheet metal fin-grid matrix 32 within each conduit 12 to increase the heat transfer surface. The matrix 32 may extend the entire length of the conduit 12 or only part of the length; if the latter, the matrix 32 should be located in the area of maximum heat, i.e. the center portion of each length of conduit 12. Such a matrix 32 may take the form of corrugated metal sheets separated by flat metal sheets, as illustrated; this type of construction in effect converts each conduit 12 into a plurality of parallel conduits. However, any high heat conductive material network or matrix may be used to pack the conduits 12, so long as the flow of air therethrough is not substantially inhibited. Restriction nozzles 34 and 38 are preferably provided at the outlets and inlets, respectively, of the conduits 12.

A fireplace fire of wood, coal or other fuel media is ignited on top of the heat transfer conduits 12 and the feeder tube 30 which also functions as a heat transfer conduit. Such fire is retained by the front panel 16, the inclined front log retainer 16', the side panels 18, the side log retainers 18', the forward wall of the distribution manifold 20, the angled top wall 20' of the distribution manifold 20, and the expanded metal grate 24. The burning fire media transfers heat to the feeder tube 30, the distribution manifold 20, the heat transfer conduits 12 and the heat transfer matrixes 32 located in each heat transfer conduit 12.

The blower 28, preferably electrically operated, is located at either right hand or left hand side of the log retaining front panel 16 of the fireplace heat transfer unit 10 (left hand location shown in FIG. 1). The blower 28 generates ample capacity to force the air through the system with sufficient emission output to overcome the draft effects of the fireplace. The blower 28 is preferably installed in a heat-protective blower enclosure 36 constructed of or lined with suitable insulating material. When the blower 28 is in operation, room air is drawn through the blower 28 and directed through the heated feeder tube 30 to the heated distribution manifold 20.

The pre-heated air is distributed through the rear orifices of the heat transfer conduits 12 which may be restricted by the provision of rear orifice turbulator plates 38 located at the juncture orifice of the forward wall of the distribution manifold 20 and each heat transfer conduit 12. The rear orifice turbulator plates 38 are restrictive in diameter setting up turbulence as heated air is forced from the distribution manifold 20 to the heat transfer conduits 12. The agitation of the heated air entering the heat transfer conduits 12 considerably increases its heat transferability. This agitated heated air is then forced through the conduits 12 in contact with the heat transfer matrixes 32 which have been superheated from immediate proximity of the burning fire media and glowing coal bed. The construction of the heat transfer matrixes 32 multiplies the heated surface to which the agitated air is exposed optimizing heat transference. The heated air in the heat transfer conduits 12 is then forced through the front restrictor orifices 34, the restricting diameters of which create positive pressure throughout the system assuring that flue gas cannot be drawn into the system. The superheated air is then directed into the room or conveyed by ducting (not shown) to remote areas.

When the fireplace heat transfer unit 10 is not in use, ashes and spent coals may be easily cleaned from the expanded metal grate 24 by shaking it. The expanded metal grate 24 lies loosely in the grate enclosure and is readily accessible through the grate slot 26 in the front panel 16 of the unit 10 for cleaning.

An innovative feature of this invention is that the heat transference from the burning fuel to the system air is accomplished at the hottest point of the fire which air is then conveyed through the shortest possible route directly into the room space to be heated with a minimum of heat loss (which heat loss would be increased proportionately if the emission conduits were of greater length as necessitated by a curved design, such curved lengths being subjected to the draft-flow of the fireplace causing a cooling effect).

The plenum type construction of the grate enclosure concentrates the burning fire media to the most effective heat transfer areas, off-falling pieces of burning and shifting logs being retained by the front log retainer 16', the side log retainers 18' and the angled top wall 20' of the distribution manifold 20. Such off-falling pieces are directed back to the flowing coal bed on the expanded metal grate 24, which coals surround the heat transfer conduits 12 partially flexible feeder tube 30. Agitated air is passed through the conduits 12 which may include the multiplied surfaces of the heat transfer matrixes 32 at the very core of the fire and projected through restricting emission orifices 34 with distribution force.

The burning logs or other fuel media which rest on top of the heat transfer conduits 12 conduct heat to such conduits 12, and break up into flowing coals on combustion, which coals are retained by the expanded metal grate 24 forming a glowing coal bed around and beneath the heat transfer conduits. As indicated above, the room air is drawn into the blower 28, passed through the feeder tube 30 to the air distribution manifold 20 which acts as the back support for the burning fire media. From the heated distribution manifold 20 the blower forced air travels through restricting orifices 38 which cause heat absorbing turbulence as the air passes into the heated series of out-feeding heat transfer conduits which together with the manifold 20, support the burning media and are surrounded by glowing coals. The turbulent air passing through the heat transfer conduits 12 absorbs the intense heat from the hottest part of the fire, particularly when the heat transfer conduits have an internal sheet metal fin-grid matrix 32 to increase the heat transfer surface. Restrictive nozzles 34 at the emission orifices cause a heat transfer chamber effect within the conduits 12 and give distribution force to the superheated air emitted to the room or conveyed by ducting to other rooms.

Prior to igniting the fire, water may be introduced into the distribution manifold through one of the heat transfer conduits which water when the system is in operation provides desirable humidity to otherwise relatively dry heated air.

The heat transfer unit 10 may be made of ferrous or non-ferrous metals; it is inexpensively constructed of simple sheet metal forms and tubes. No height adjustment is necessary in relation to the height of the fireplace opening.

As noted above, the distribution manifold as illustrated in FIG. 1 is trapezoidal in cross section, but in application may be round, rectangular, triangular or polygonal in cross-section; and the heat transfer conduits 12 as illustrated are round in cross section, but may be rectangular, triangular or polygonal cross sections in application. While there are four such heat transfer conduits 12 illustrated in FIG. 1, the invention may utilize more or less than four such conduits in application, depending on fire place size and other factors. The rear turbulator plates 38 are shown in FIG. 1 to resemble round washers. In application these openings may be regular or irregular shapes other than round to enhance turbulative effect. While the grating 24 is preferably of expanded metal, it will be understood that any heavy screen-like construction may be used.

It will be obvious to those skilled in the art that various changes may be made without departing from the scope of the invention and the invention is not to be considered limited to what is shown in the drawing and described in the specification.

What is claimed is:

1. A fireplace heat transfer unit, comprising:

a forced-air-fed distribution manifold adapted to extend across the rear of a fireplace substantially parallel to the back wall thereof;

a series of heat transfer conduits each defining a respective heat-transfer chamber, interconnected with said manifold, extending therefrom toward the fireplace opening and including a restrictive emission orifice for jetting air directly into a room;

a rectangular grate enclosure having front and sidewalls and supporting said heat transfer conduits, said grate enclosure having support means extending downwardly therefrom;

a tube connected to said manifold;

a screen-like grating means supported by and constituting the floor of said grate enclosure and being positioned closely below said heat transfer conduits for holding glowing coals in proximity to and in possible direct contact with said conduits for optimum heat transfer; and blower means for forcing air through said tube, into said manifold and thence through said conduits and out of said restrictive openings, said blower means being positioned such that it will be within the fireplace when the heat transfer unit is in operation, said blower means including a heat-protective housing.

2. A fireplace heat transfer unit according to claim 1, wherein said grate enclosure is a plenum-type enclosure with side, front and back walls and said walls angle outwardly at the top thereof to retain off-falling burning fuel pieces and direct these fuel pieces back to the grating, the enclosing walls of said enclosure concentrating heat to the heat transfer area.

3. A fireplace heat transfer unit according to claim 1, further comprising a respective restricting input orifice between the distribution manifold and each said heat transfer conduits to agitate the air forced therethrough, enhancing the heat transference of the air.

4. A fireplace heat transfer unit according to claim 3, wherein each heat transfer conduit has means to give distribution force to the heated air emitted to the room and creating a positive pressure throughout the system insuring that flue gas cannot be drawn in and emitted to the room, said means comprising one of said restricting emission orifices and one of said restrictive input orifices, and wherein said restriction orifices causes each said conduit to act as a heat transfer chamber.

5. A fireplace heat transfer unit according to claim 1, further comprising a sheet metal fin-grid heat transfer matrix within each heat transfer conduit to substantially increase the heat transfer surface through which the system air flows, said matrix being located in at least the center portion of each conduit.

6. A fireplace heat transfer unit according to claim 1 with further means for introducing water into the manifold, whereby the water is absorbed by heated air flowing through the system providing desirable humidity to otherwise relatively dry heated air.

7. A fireplace heat transfer unit according to claim 1 wherein the screen-like grating is of expanded metal and rests loosely on supportive metal returns, the returns being bent inward from the side and front panels, such a return also being assembled to the front wall of the distribution manifold.

8. A fireplace heat transfer unit as defined by claim 1, wherein said grating is made readily accessible for removal through a full dimensional slot in the front wall of the heat transfer unit.

9. A fireplace heat transfer unit as defined by claim 1, wherein said tube connected to said manifold is positioned at least in part within said grate enclosure in close proximity to and above said screen-like grating for receiving heat from the glowing coals and for possible direct contact therewith.

* * * * *